US005458169A

United States Patent [19]

Biafore

[11] Patent Number: 5,458,169

[45] Date of Patent: Oct. 17, 1995

[54] GROUT DISTRIBUTING DEVICE

[76] Inventor: John A. Biafore, 25 Sperry La., Meriden, Conn. 06450

[21] Appl. No.: 177,919

[22] Filed: Jan. 6, 1994

[51] Int. Cl.[6] ..... E04G 21/20

[52] U.S. Cl. ..... 141/333; 141/237; 141/331; 141/364; 52/127.3; 52/DIG. 1; 52/749.13

[58] Field of Search ..... 141/234, 236–240, 141/247, 331, 333, 340–343, 363–366; 52/749, DIG. 1, 127.3, 127.4, 743, 744, 750

[56] References Cited

U.S. PATENT DOCUMENTS

| | | | |
|---|---|---|---|
| 220,609 | 10/1879 | Hartley | 141/234 |
| 402,379 | 4/1889 | Xander et al. | 141/333 X |
| 1,655,021 | 1/1928 | Nord | 141/333 |
| 2,940,298 | 6/1960 | Joseph | 52/749 |
| 3,555,751 | 8/1968 | Thorgusen | 52/127.3 |
| 3,732,903 | 5/1973 | Oates | 141/237 |
| 4,352,445 | 10/1982 | Cusumano et al. | 52/749 X |
| 4,585,041 | 4/1986 | Cavanagh | 141/237 X |
| 4,709,526 | 12/1987 | Crumby | 52/749 |
| 4,903,450 | 2/1990 | Adams | 52/293.2 |
| 5,033,637 | 7/1991 | Webb | 141/364 X |

FOREIGN PATENT DOCUMENTS

| | | | |
|---|---|---|---|
| 0970383 | 6/1950 | France | 141/234 |
| 1303568 | 8/1962 | France | 52/749 |
| 2435577 | 5/1980 | France | 52/749 |
| 0322156 | 7/1957 | Switzerland | 52/749 |
| 0009813 | of 1906 | United Kingdom | 141/240 |
| 2150198 | 6/1985 | United Kingdom | 52/750 |

*Primary Examiner*—J. Casimer Jacyna
*Attorney, Agent, or Firm*—McCormick, Paulding & Huber

[57] ABSTRACT

A grout distributing device having a body including a bottom wall and inner and outer sidewall assemblies which cooperate to define a common upwardly open grout receiving hopper in the upper portion of the body. The common hopper communicates with a pair of funnel-like grout distribution passageways therebelow which open through the bottom wall. The inner and outer wall assemblies are formed by trapezoidal plates, the inner wall assembly being disposed wholly within the confines of the outer wall assembly.

8 Claims, 2 Drawing Sheets

GROUT DISTRIBUTING DEVICE

BACKGROUND OF THE INVENTION

This invention relates in general to fluent material handling devices and deals more particularly with a grout distributing device for use in filling voids in masonry walls.

Building construction codes in many sections of the United States contain seismic provisions which require that voids in walls built from masonry blocks be filled with a concrete or grout mix. Walls constructed in compliance with these codes afford increased resistance to earthquake, wind and hurricane damage. However, these code requirements impose additional burdens on masonry contractors.

The vertically disposed voids in a wall of the aforedescribed type must be filled from above. Each void is usually individually filled. Inefficient makeshift devices are often used in the void filling operation resulting in spillage and material waste and requiring otherwise unnecessary job site cleanup operations all of which add substantially to the cost of construction.

It is the general aim of the present invention to provide an improved device for use in filling voids in a masonry wall and which enables a plurality of adjacent voids in a wall to be simultaneously filled in a single operation. It is a further aim of the invention to provide an improved void filling device which reduces material spillage and waste and protects an associated portion of a wall from grout contamination during the filling operation, thereby increasing the efficient of the filling operation while reducing the need for job site clean-up operations.

SUMMARY OF THE INVENTION

In accordance with the invention a grout distributing device has a body including a bottom wall and an outer wall assembly extending upwardly and outwardly from the bottom wall and terminating at an open upper end. The upper end portion of the outer wall assembly defines a common grout receiving hopper within the upper portion of the body. An inner wall assembly disposed below the grout receiving hopper and wholly within the confines of said outer wall assembly defines a plurality of downwardly and inwardly inclined grout distribution passageways. Each of the passageways communicate with the common grout receiving hopper and opens through the bottom wall.

DETAILED DESCRIPTION OF PREFERRED EMBODIMENT

Figure 1:
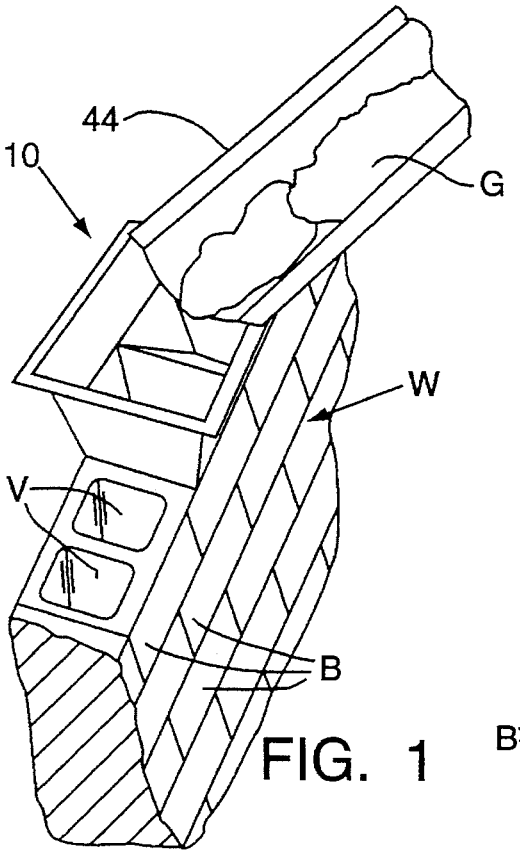
FIG. 1 is a perspective view of a grout distributing device embodying the present invention and shown in filling position on the upper surface of an associated masonry wall.

The grout distributing device of the present invention is particularly adapted for use in filling a plurality of adjacent voids in a masonry wall. In FIG. 1 a device embodying the invention and indicated generally by the reference numeral

10 is shown in a rifling position on the upper surface of a typical masonry wall designated generally by the letter W. The masonry wall W is formed from a plurality of vertically stacked courses of masonry blocks indicated by the letters B, B. Such blocks are available in a variety of sizes. A typical block has a plurality of core openings extending vertically through it, each core opening being separated from an immediately adjacent core opening by a web or dividing wall. Each of the illustrated masonry blocks B, B, has two such core openings C, C separated by a single web designated by the letter A. Each course of blocks B, B is horizontally offset relative the course immediately below it by a distance equal to approximately one half the length of a block B, in a manner well known in the masonry art. The core openings C, C in each course are in general vertical registry with core openings in the courses therebelow and cooperate to form vertically extending voids V, V within the masonry wall W which open upwardly through the upper surface of the masonry wall as shown in FIG. 1. At least some of these voids filled with a concrete or grout mix indicated at G in FIG. 1 to form reinforcing columns within the finished wall.

Considering now the grout distributing device in some detail, the illustrated device 10 preferably comprises a weldment fabricated from steel plates welded together in assembly and has a body including a generally rectangular bottom wall 12 preferably sized to overlie generally complement an associated portion of the upper surface of a masonry block wall, such as the wall W, in covering relation to associated openings in the upper surface of the wall. The rectangular bottom wall 12 has a width dimension approximately equal to the width dimension of the masonry wall W or more specifically the width dimension of a block B from which the wall W is constructed. The grout distributing device of the present invention may be constructed and arranged to simultaneously fill two or more adjacent voids V, V and for this reason the length dimension of the bottom wall 12 may vary. However, the illustrated device 10 is constructed and arranged to simultaneously fill two adjacent voids in the wall W and for this reason the length dimension of the device bottom wall 12 is substantially equal to the length dimension of a single block B. Two generally rectangular outlet openings 14, 14 are formed in the bottom wall 12 for registry with a pair of adjacent rectangular upwardly open voids V, V in the masonry wall W when the device 10 is disposed in filling position on an upper surface of the latter wall.

Figure 5:
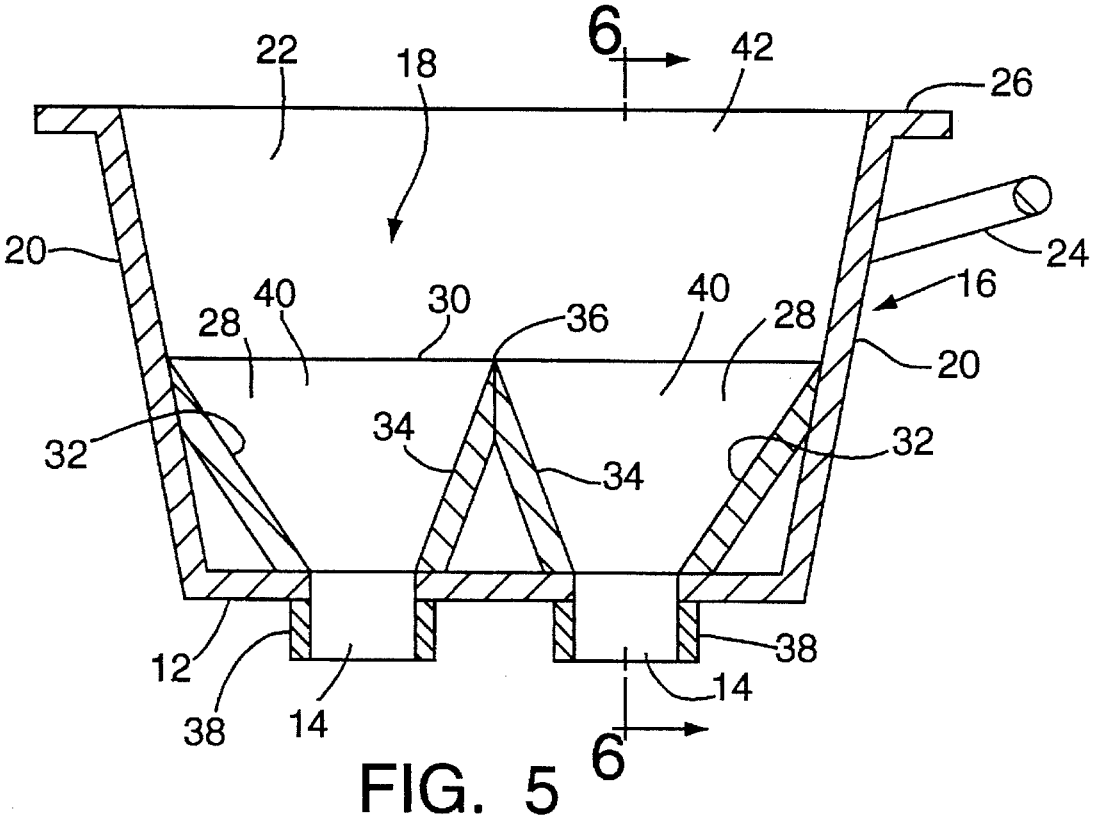
FIG. 5 is a somewhat further enlarged sectional view taken along the line 5—5 of FIG. 4.
Figure 6:
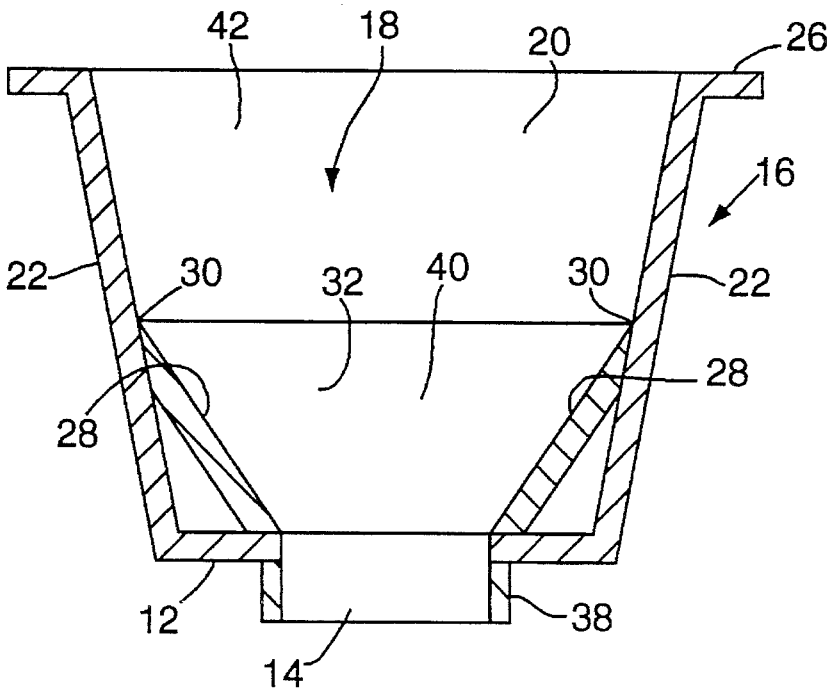
FIG. 6 is a sectional view taken along the line 6—6 of FIG. 5.

The body of the grout distributing device 10 is further defined by an outer wall assembly indicating generally at 16, and an inner wall assembly, designated generally by the numeral 18. The outer wall assembly 16 includes a pair of opposing trapezoidal outer end walls 20, 20 disposed at opposite ends of the bottom wall 12. The outer end walls 20, 20 are respectively upwardly and outwardly inclined from the bottom wall, as best shown in FIG. 5. The outer wall assembly 16 also includes a pair of trapezoidal outer sidewalls 22, 22 respectively connected to the opposite sides of the bottom wall 12 along the opposite peripheral side edges of the bottom wall 12. The outer side walls 22, 22 are inclined upwardly and outwardly from the bottom wall 12 and have outer ends connected to the outer side edges of the end walls 20, 20, as best shown in FIGS. 5 and 6. A generally horizontally disposed and generally rectangular annular flange 26 surrounds the open upper end of the outer wall assembly 16 and projects horizontally outwardly from it forming a stiffener for the open upper end of the device 10. Preferably, and as shown, at least one of the outer end walls 20, 20 has a handle 24 welded or otherwise suitably attached to it.

The inner wall assembly 18 is also formed from a plurality of trapezoidal plates. These plates are welded together in assembly with each other and with the outer wall assembly 16, that is the portion of the outer wall assembly above the inner wall assembly 18, and the bottom wall 12. More specifically, the inner wall assembly 18 includes a pair of opposing trapezoidal inner sidewalls 28, 28. The inner sidewalls are welded to the bottom wall 12 and extend along the respectively associated opposite side edges of the outlet openings 14, 14. Each inner sidewall 28 is inclined upwardly and outwardly from the bottom wall 12 and has horizontally disposed upper edge 30 welded to an associated outer sidewall 22 in downwardly spaced relation to the upper end of the outer wall assembly 16.

The inner wall assembly 18 further includes a pair of trapezoidal inner end walls 32, 32 which are welded to the bottom wall 12 and extend along the respectively associated outer ends of the outlet openings 14, 14. Each inner end wall 32 is inclined upwardly and outwardly from the bottom wall 12 to an associated outer end wall 20 and has a horizontally disposed upper edge welded to a respectively associated outer end wall in downwardly spaced relation to the upper end of the outer wall assembly 16. The inner end walls 32, 32 are welded to and extend between the inner sidewalls 28, 28.

Figure 3:
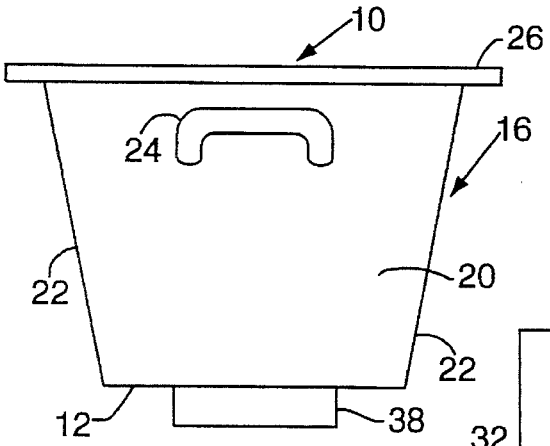
FIG. 3 is an end view of the group distributing device.
Figure 4:
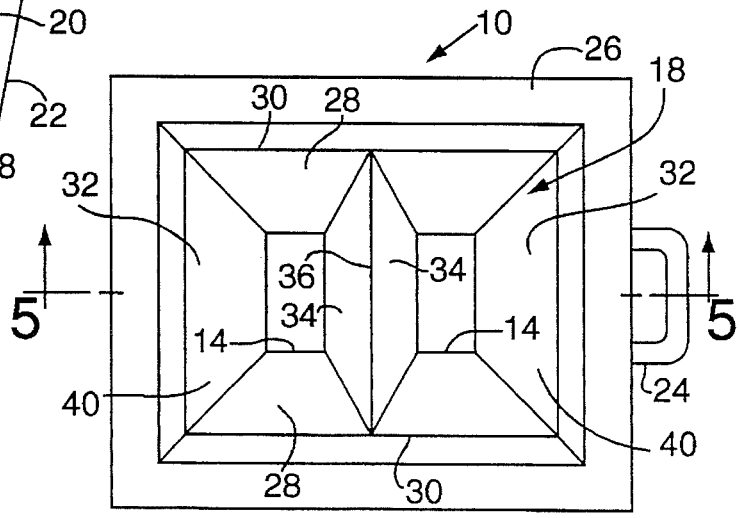
FIG. 4 is a top plan view of the grout distributing device.

The inner wall assembly 18 also includes a pair of trapezoidal inner dividing walls 34, 34. Each inner dividing wall 34 is welded to the bottom wall 12 and extends along the inner edge of a respectively associated outlet openings 14. The inner dividing walls are also welded to and extend between the inner sidewalls 28, 28. Each dividing wall 34 is inclined upwardly and inwardly from the bottom wall 12 and toward the outer dividing wall, substantially as shown in FIG. 3. The horizontally disposed upper edges of the two dividing walls 34, 34 are joined and form a horizontally disposed apex 36 which extends between the inner sidewalls 28, 28, as best shown in FIG. 3. A pair of rectangular tubular collars 38, 38 welded to the lower surface of the bottom wall 12 depend from the bottom wall and form tubular extensions of the outlet openings 14, 14 as best shown in FIGS. 3 and 4.

The inner wall assembly 18 defines a plurality of downwardly converging funnel-like grout distribution passageways 40, 40 wholly disposed within the outer wall assembly and terminating at the outlet openings 14, 14. The upper portion of the outer wall assembly 16, that is the portion of the outer wall assembly above the inner wall assembly 18, forms a common grout receiving hopper 42 for receiving and containing a quantity of grout G and simultaneously supplying grout to each of the grout distribution passageways 40, 40 immediately therebelow and within the outer wall assembly 16.

Figure 2:
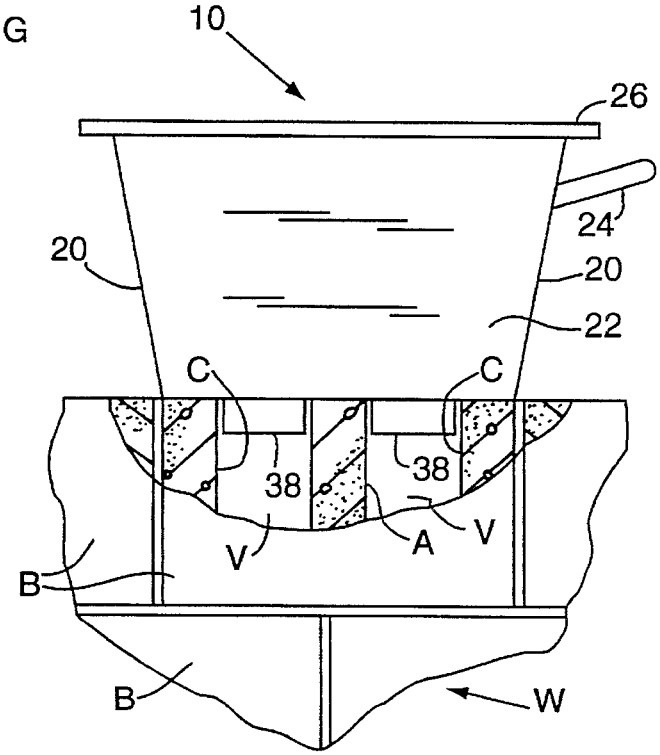
FIG. 2 is a somewhat enlarged side elevational view of the grout distributing device as shown in FIG. 1.

Preparatory to filling voids in a masonry wall, such as the wall W, the grout distributing device 10 is positioned on a portion of the upper surface of the masonry wall with the collars 38, 38 disposed within a pair of respectively associated adjacent voids V, V as shown in FIGS. 1 and 2. When the device 10 is positioned on the wall W in the aforedescribed manner the outlet opening 14, 14 will be in general registry with the voids V, V which open through the upper surface of the masonry wall. A concrete mix or grout is then fed from a grout chute 44 (FIG. 1) or other convenient feeding means and into the common grout receiving hopper in the upper end portion of the device 10. Grout fed into the common hopper 42 is divided by the funnel-shaped passageways defined by the inner wall assembly and simultaneously fed downwardly through the outlet openings 14, 14 and into and through the tubular extensions 38, 38 and into each of the adjacent voids V, V to be filled. If reasonably care is exercised in feeding grout into the device there will be no substantial spillage and the upper surface of the wall W in the region of the device 10 will remain substantially free of grout. When one pair of voids has been filled the device 10 is moved along the upper surface of the wall and into alignment with the next successive pair of voids V, V. The aforedescribed operations are repeated until the various voids in the wall have been filled.

Since the device 10, including the grout receiving hopper and the funnel-shaped distribution passageways, is defined by substantially smooth downwardly and inwardly inclined surfaces the device may be readily cleaned by hosing it down with water before grout has had an opportunity to dry and harden on these surfaces.

While the invention has been illustrated and described with reference to a distributing device having two outlet openings it should now be apparent that the structure may also be made with three or more such outlet openings fed from a common grout receiving hopper and such construction is contemplated within the scope of the patent.

I claim:

1. A grout distributing device for simultaneously filling adjacent voids opening through the upper surface of a generally rectangular masonry block wall, said grout distributing device comprising an outer wall assembly including a generally rectangular bottom wall sized to overlie and generally complement an associated portion of the upper surface of a masonry block wall and having a width dimension substantially equal to the width dimension of the masonry block wall, said bottom wall having outlet openings formed therein for registry with adjacent upwardly open voids in the masonry block wall, a pair of opposing trapezoidal outer end walls disposed at opposite ends of the bottom wall, each of said outer end walls being connected to an associated end of said bottom wall along a peripheral edge of said bottom wall and inclined upwardly and outwardly from said bottom wall, a pair of trapezoidal outer side walls disposed at opposite sides of said bottom wall, each of said outer side walls being connected to said bottom wall along a peripheral edge of said bottom wall, said outer side walls being inclined upwardly and outwardly from said bottom wall and having outer end edges connected to the outer side edges of said end walls, a horizontally disposed generally rectangular annular flange surrounding the upper end portion of said outer wall assembly and projecting outwardly from it forming a stiffener at the open upper end of said grout distributing device, an inner wall assembly formed from a plurality of trapezoidal plates connected together in assembly with each other and with said outer wall assembly, said inner wall assembly including a pair of trapezoidal inner end walls connected to said bottom wall and extending along respectively associated outer ends of said outlet openings therein, each of said inner end walls being inclined upwardly and outwardly from said bottom wall to an associated one of said outer end walls and having a horizontally disposed upper edge downwardly spaced from the upper end of said outer wall assembly, a pair of opposing inner side walls connected to said bottom wall, each of said inner side walls extending along a respectively associated side edge of said outlet openings and inclined upwardly and outwardly from said bottom wall, each of said inner side walls having a horizontally disposed upper edge connected to an associated one of said outer side walls in downwardly spaced relation to the upper end of said outer side wall assembly, a pair of trapezoidal inner dividing walls, each of said inner dividing walls extending along the inner edge of a respectively associated one of said outlet openings, said inner dividing walls extending between said inner side walls, each of said dividing wall being inclined upwardly and inwardly from said bottom wall toward the other of said dividing walls, the upper edges of said dividing walls being joined to form a horizontally disposed apex extending between the upper edges of said inner side walls, and a pair of rectangular tubular collars connected to said bottom wall and depending from said bottom wall and forming tubular extensions of said outlet openings.

2. A grout distributing device as set forth in claim 1 wherein said grout distribution passageways and said tubular extensions have rectangular cross sections.

3. A grout distributing device as set forth in claim 1 including a generally U-shaped handle attached to an outer surface of an associated one of said outer end walls in downwardly spaced relation to the upper end of said grout distributing device.

4. A grout distributing device as set forth in claim 1 wherein said masonry block wall is formed by a plurality of substantially identical generally rectangular masonry blocks and said bottom wall has a length dimension substantially equal to the length dimension of one of said blocks.

5. A grout distributing device for simultaneously filling adjacent voids opening through the upper surface of a generally rectangular masonry block wall, said grout distributing device comprising an outer wall assembly including a horizontally disposed generally rectangular bottom wall sized to overlie and generally complement an associated portion of the upper surface of a masonry block wall, said bottom wall having outlet openings formed therein and spaced inwardly from the outer edge of said bottom wall for registry with adjacent upwardly open voids in the masonry block wall, a pair of opposing outer end walls disposed at opposite ends of said bottom wall, each of said outer end walls being connected to said bottom wall along an associated end edge of said bottom wall and extending upwardly from said bottom wall, and a pair of outer side walls disposed at opposite sides of said bottom wall, each of said outer side walls being connected to said bottom wall along an associated outer side edge of said bottom wall, said outer side walls extending upwardly and outwardly from said bottom wall, an inner wall assembly formed from a plurality of trapezoidal plates connected together in assembly with each other and with said outer wall assembly, said inner wall assembly including a pair of trapezoidal inner end walls connected to said bottom wall and extending along respectively associated outer ends of said outlet openings, each of said inner end walls being inclined upwardly and outwardly from said bottom wall to an associated one of said outer end walls and having a horizontally disposed upper edge downwardly spaced from the upper end of said outer wall assembly, a pair of opposing inner side walls connected to said bottom wall, each of said inner side walls extending along a respectively associated side edge of said outlet openings and inclined upwardly and outwardly from said bottom wall, each of said inner side walls having a horizontally disposed upper edge connected to an associated one of said outer side walls in downwardly spaced relation to the upper end of said outer side wall assembly, a pair of trapezoidal inner dividing walls, each of said inner dividing walls extending along the inner edge of a respectively associated one of said outlet openings, said inner dividing walls connected to and extending between said inner side walls, each of said dividing wall being inclined upwardly and inwardly from said bottom wall toward the other of said dividing walls, the upper edges of said dividing walls being joined and forming a horizontally disposed apex extending between the upper edges of said inner side walls, and tubular collars connected to said bottom wall and depending from said bottom wall and forming tubular extensions of said outlet openings.

6. A grout distributing device as set forth in claim 5 including a generally handle attached to an outer surface of an associated one of said outer end walls in downwardly spaced relation to the upper end of said grout distributing device.

7. A grout distributing device as set forth in claim 5 wherein said masonry block wall is formed by a plurality of substantially identical generally rectangular masonry blocks and said bottom wall has a width dimension substantially equal to the width dimension of one of said blocks and a length dimension substantially equal to the length dimension of one of said blocks.

8. A grout distributing device as set forth in claim 5 including a horizontally disposed generally rectangular annular flange surrounding the upper end portion of said outer wall assembly and projecting outwardly from it forming a stiffener at the open upper end of said grout distributing device.

* * * * *